United States Patent [19]

McFarland

[11] 4,173,945

[45] * Nov. 13, 1979

[54] ELECTROSTATIC PRINTING MACHINE WITH IMPROVED WEB-DEVELOPING SYSTEM

[75] Inventor: Keith E. McFarland, Woodside, Calif.

[73] Assignee: Xerox Corporation, Stamford, Conn.

[ * ] Notice: The portion of the term of this patent subsequent to Nov. 13, 1994, has been disclaimed.

[21] Appl. No.: 553,591

[22] Filed: Feb. 27, 1975

[51] Int. Cl.[2] ..... G03G 13/10

[52] U.S. Cl. ..... 118/660; 118/DIG. 23

[58] Field of Search ..... 118/637, DIG. 23, 50, 118/659, 660; 355/3 P, 10; 427/15

[56] References Cited

U.S. PATENT DOCUMENTS

| | | | |
|---|---|---|---|
| 2,752,833 | 7/1956 | Jacob | 355/10 |
| 2,856,848 | 10/1958 | Pritchard | 118/DIG. 23 |
| 3,149,550 | 9/1964 | Lohse et al. | 118/DIG. 23 |
| 3,371,651 | 3/1968 | Johnson et al. | 118/637 |
| 3,407,786 | 10/1968 | Beyer et al. | 427/15 |
| 3,474,757 | 10/1969 | Dreher | 118/DIG. 23 |
| 3,536,594 | 10/1970 | Pritchard | 118/50 |
| 3,619,053 | 11/1971 | Mannik | 355/10 |
| 3,859,960 | 1/1975 | Lloyd | 118/637 |
| 3,901,188 | 8/1975 | Eberlein | 118/637 |
| 3,916,828 | 11/1975 | Gross | 112/637 |
| 3,937,177 | 2/1976 | Lloyd | 118/DIG. 23 |

*Primary Examiner*—Mervin Stein

*Attorney, Agent, or Firm*—W. Douglas Carothers, Jr.

[57] ABSTRACT

An electrostatic printing machine of the type having means for applying fluid toner material to a surface of a web of print material includes a toner fountain and pump for pumping toner into the fountain from a body of toner. A vacuum channel member extends transversely of the path of movement of the web for removing toner from the surface. The vacuum channel member is formed with an upwardly directed open cavity surrounded by walls which terminate at their upper end edges in substantially a common plane for supporting the web thereacross substantially sealing the cavity when the web is so located. A flow passage is formed to lead fluid toner out of the cavity from below and flow-operated vacuum means in the form of an aspirator is disposed on the discharge side of the pump and coupled in fluid communication to the flow passage, the vacuum means being further disposed and arranged to pass a flow of toner therethrough in a manner serving to apply a suction to the cavity for withdrawing toner material from the vacuum cavity via the flow passage therein, the suction being applied to a degree responsive to the rate of passing toner through the vacuum means.

10 Claims, 8 Drawing Figures

FIG_1
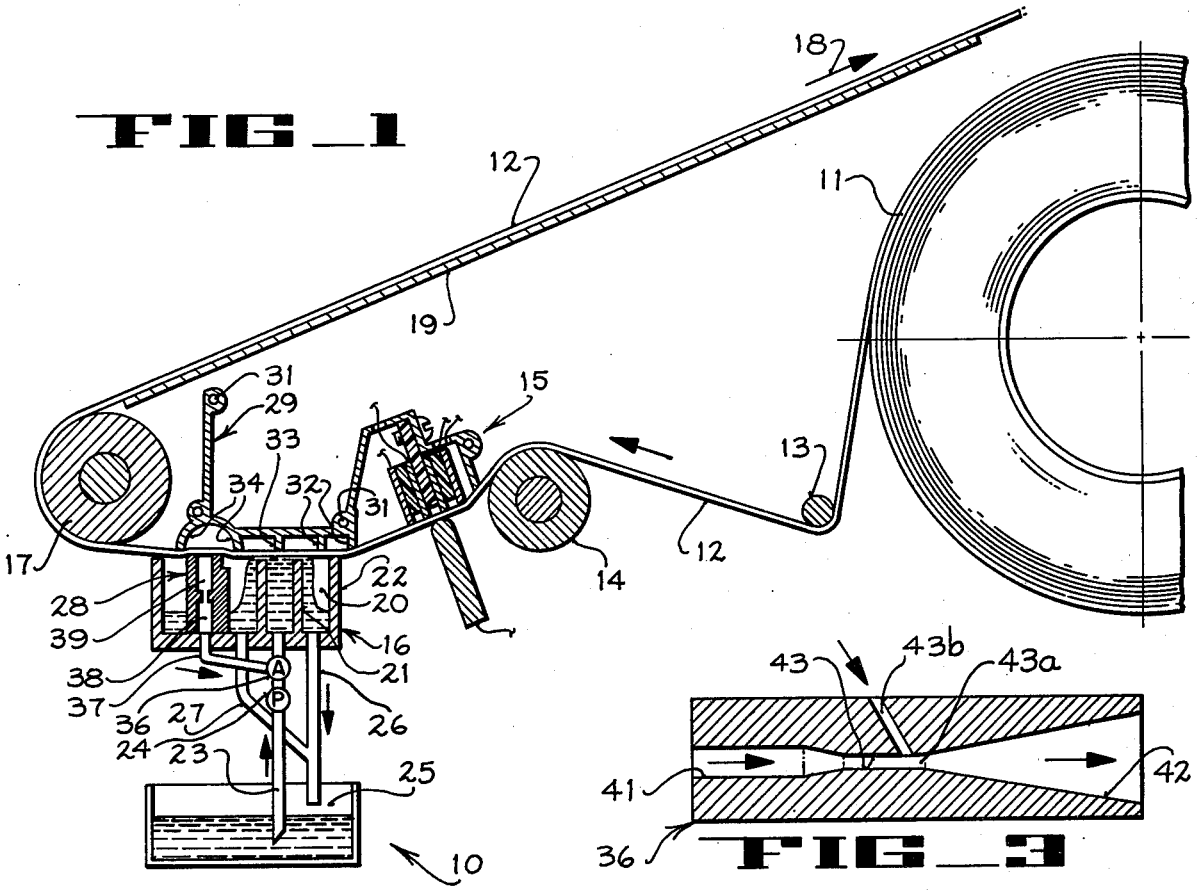
FIG_3
FIG 2
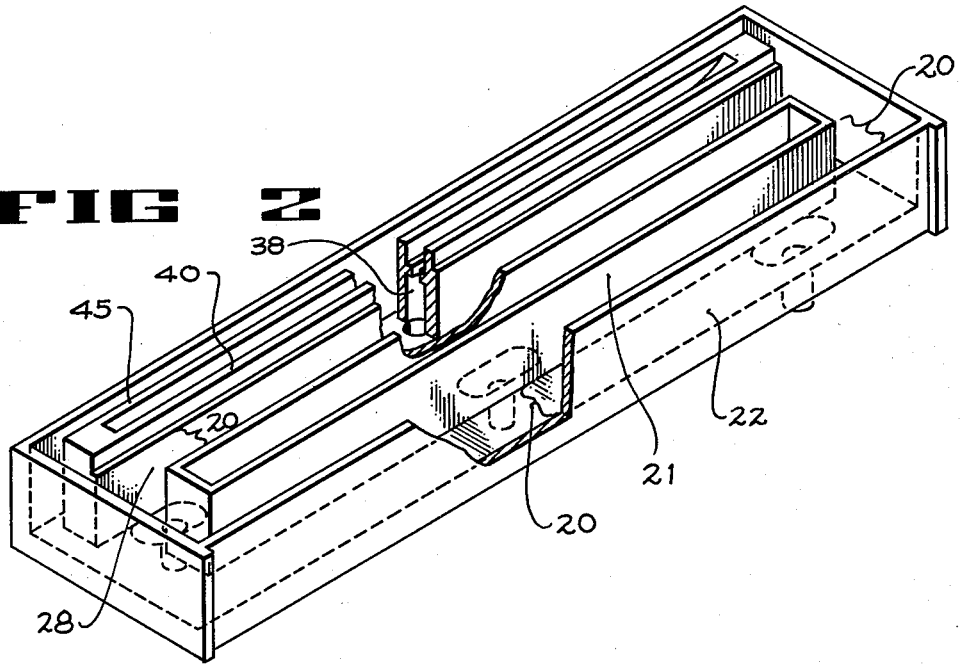

FIG_5
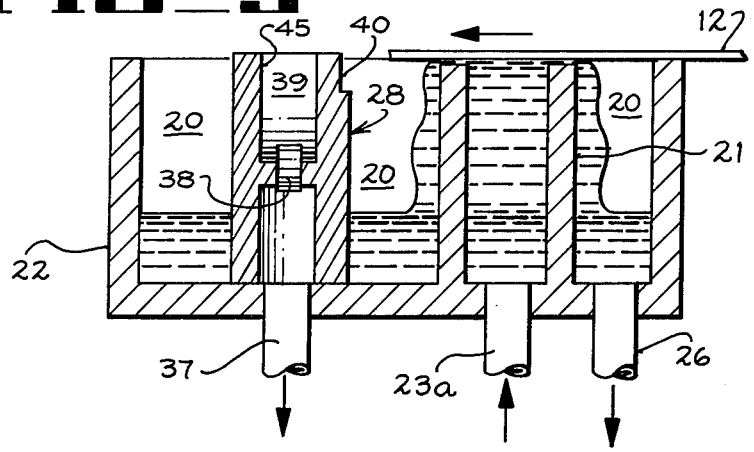
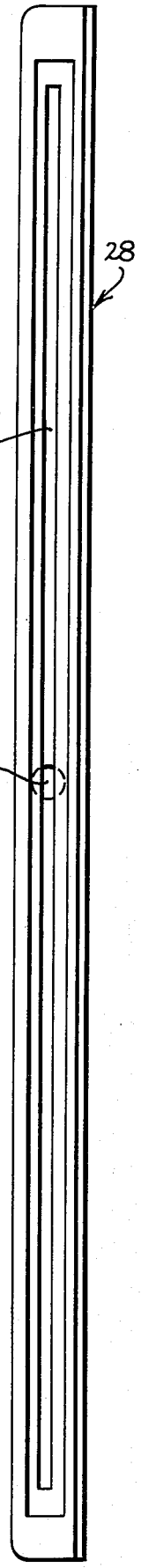
FIG_4
FIG_6
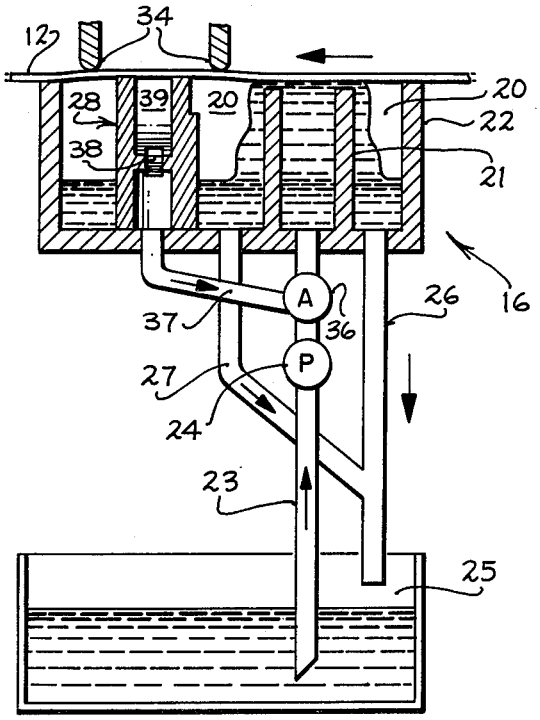
FIG_7
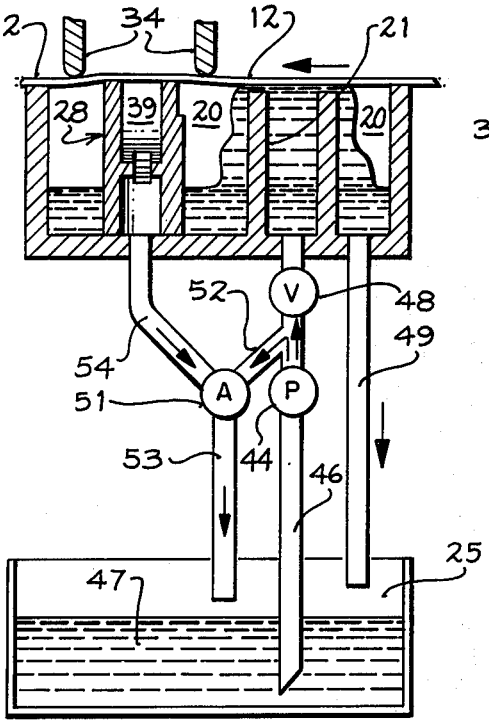

ELECTROSTATIC PRINTING MACHINE WITH IMPROVED WEB-DEVELOPING SYSTEM

BACKGROUND OF THE INVENTION

This invention pertains to electrostatic printing machines and more particularly to an improved web-developing system and method for same featuring an improved toner fountain recovery system.

In general, in some electrostatic printing machines, an elongate web of material is moved in a predetermined path where, at one station, portions of the surface of the web will be electrostatically charged to create a prerecorded latent image on the web. Thereafter, the latent image is developed in response to application of toner material thereto. In one arrangement, the web passes in close proximity across the top of a toner fountain in which liquid toner is pumped to overflow the side edges of the fountain and spill into a catch basin disposed around the toner fountain for return to a reservoir.

One example of such a toner fountain is shown in U.S. Pat. No. 3,729,123, issued Apr. 24, 1973.

In apparatus of the kind described, the printing web is wetted by toner as it is drawn across the toner fountain. Means are provided for physically removing first the bulk or main portion of the liquid toner and then the remainder thereby "drying" the web.

As disclosed herein, vacuum means operating with a degree of suction responsive to the flow rate of the toner supplied to the toner fountain serves to recover the remainder portion of the liquid toner and to return it to a toner reservoir.

SUMMARY OF THE INVENTION AND OBJECTS

In general, in apparatus of the kind described above, an improved toner recovery system includes an elongate, hollow, channel member open at one side and formed to include side walls bounding the open side. The end edges of the side walls are disposed to extend across the path of the web for engaging a surface of the web for physically removing the bulk of the liquid toner therefrom. The open channel member includes a drain opening coupled to a fluid path serving to return the withdrawn toner material to the reservoir.

In a particularly preferred embodiment, a vacuum connection leads to the channel member to provide a suction responsive to the rate of flow of toner to the toner fountain. Thus, a flow-operated vacuum device, such as an aspirator, disposed on the discharge side of a toner pump and coupled in fluid communication to the drain opening of the channel member maintains a vacuum in the channel member to withdraw toner material from the cavity formed within the channel member in a manner whereby the degree of suction for withdrawal of toner from the channel member will be responsive to the rate of passing toner through the vacuum device.

In general, it is an object of the present invention to provide an improved toner recovery system and method for an electrostatic printer.

It is another object of the present invention to employ a flow-operated vacuum-forming device whereby a vacuum will be generated in response to the rate of flow of the stream of toner being supplied.

It is another object of the present invention to provide an improved toner recovery system wherein the vacuum can be maintained on the toner recovery channel after discontinuing supplying toner to the toner fountain.

The foregoing and other objects will be more readily evident from the following detailed description of preferred embodiments when considered in conjunction with the drawings.

BRIEF DESCRIPTION OF THE DRAWINGS

FIG. 1 shows a diagrammatic side elevation view of a system, in section, according to the invention;

FIG. 2 shows a diagrammatic, enlarged detail perspective view of a toner fountain tray and toner recovery head according to the invention;

FIG. 3 shows an enlarged section view of an aspirator device as used in the system according to the invention;

FIG. 4 shows a plan view of the toner recovery head;

FIG. 5 shows an enlarged diagrammatic end elevation section view in detail of the toner fountain assembly;

FIG. 6 shows an end elevation section view in enlarged diagrammatic form of a portion of the system shown in FIG. 1;

FIG. 7 shows an end elevation section view of another embodiment of the invention in diagrammatic form for use with portions of the construction shown in FIG. 1 and essentially replacing those portions shown in FIG. 6;

DETAILED DESCRIPTION OF PREFERRED EMBODIMENTS

Figure 8:
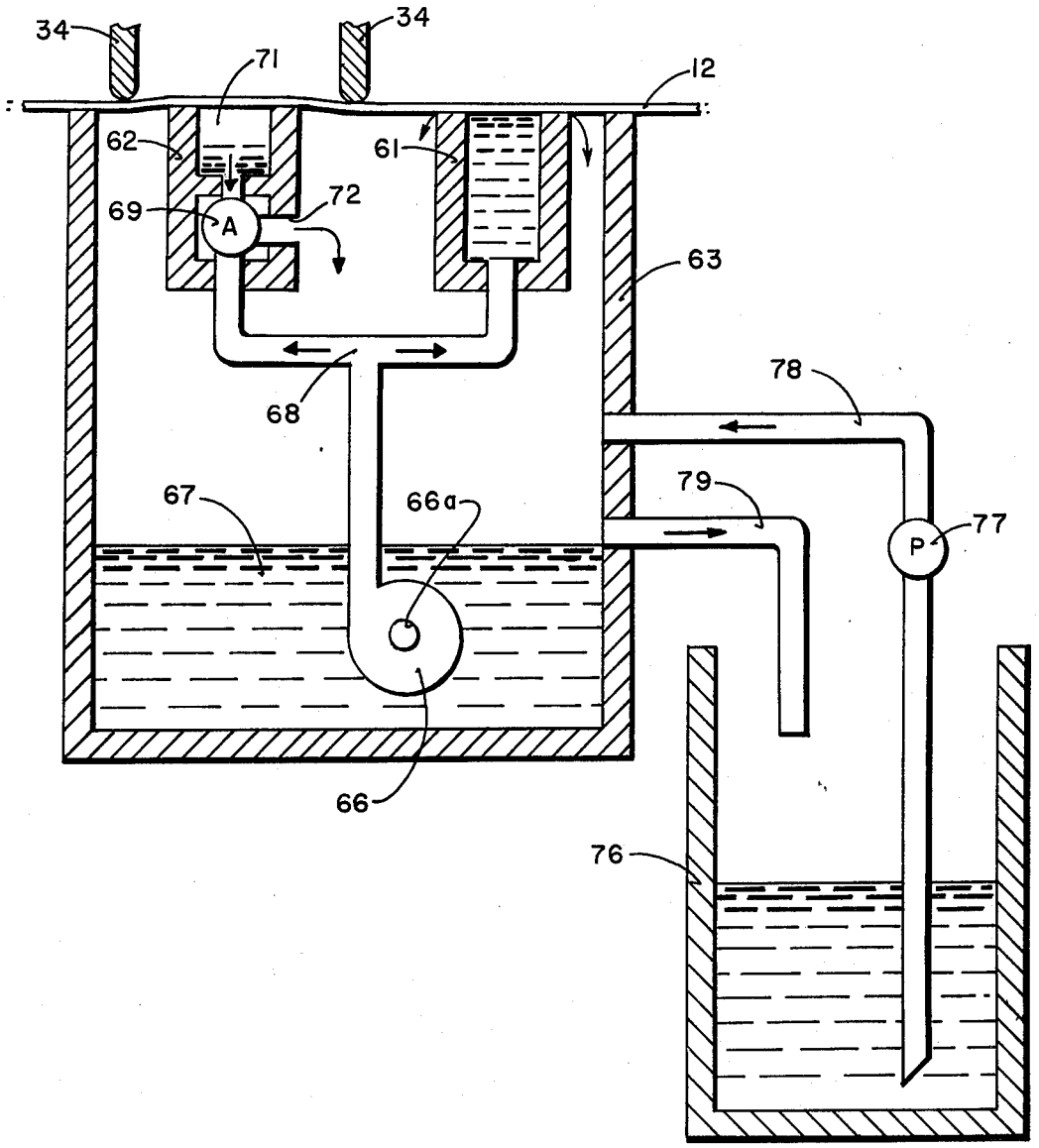
FIG. 8 shows an end elevation section view of another embodiment of the invention in diagrammatic form.

An improved toner fountain assembly and recovery system 10 is shown diagrammatically in FIG. 1. Accordingly, a roll 11 of electrostatic recording material forming a web 12 is suitably trained by means of guides 13, 14 to pass through a recording station 15 wherein discrete dots or pinpoint areas across the width of web 12 can be selectively electrostatically charged. These portions are then developed further downstream in the toner fountain and recovery assembly 16 as to be described further below. Subsequently, as web 12 passes out of assembly 16, it is trained about a roller 17 and moved upwardly in the direction of arrow 18 while supported from beneath by a platen 19.

Toner fountain and recovery assembly 16 generally includes a first elongate tray 21 or trough mounted within a tray 22 serving as a catch basin for toner overflowing from tray 21.

Means for supplying toner from a reservoir 25 thereof into tray 21 to overflow into tray 22 and permit the overflowed toner to drain back into reservoir 25 comprises the upwardly extending toner supply column 23 in which a pump 24 serves to convey toner upwardly from reservoir 25 for discharge into tray 21.

The crest of the overflowing toner from tray 21 is disposed at a level whereby it will contact the undersurface of web 12. Drainage from catch basin 22 is provided by suitable return lines fed from both sides of the channel 20 formed around tray 21 and schematically shown simply as return lines 26, 27 which lead directly back to reservoir 25.

Means for holding web 12 suitably closely adjacent to the overflowing top of tray 21 as well as to the top of a recovery head 28 includes a pressure member 29 carried by a portion of the frame assembly, such as by the screws 31 or rivets. Pressure member 29 may be extruded or molded as desired and extends transversely of the path of web 12. Pressure member 29 includes a number of downwardly depending ribs 32, 33, 34 serving, in conjunction with the top of trays 21, 22 and recovery head 28, to define the path for web 12. Accordingly, the lower edges of ribs 32, 33, 34 confine the travel of web 12 so that it passes in close proximity to the top of fountain tray 21 to ride lightly across recovery head 28.

The upper end edges 40, 45 of head 28 are each formed to provide a relatively sharp scraping edge extending transversely of the path of web 12. In this position, the upstream edge 40 serves to physically remove into channel 20 the bulk or main portion of the unadhered liquid toner previously applied to web 12 at fountain tray 21. Then, as web 12 engages edge 45, the remainder of the unadhered toner can be physically removed aided by the influence of a vacuum in recovery head 28 as now to be described.

The upper end edges 40, 45 of the transverse walls of head 28 lie substantially in a common plane whereby when web 12 passes across them, the suction formed in cavity 39 will serve to draw web 12 tightly in substantially sealed relation thereto.

Means serving to form a vacuum in head 28 to a degree responsive to the rate of pumping toner into tray 21 includes an aspirator 36 disposed in the toner supply column 23 on the discharge side of pump 24 and oriented to receive and discharge the flow of toner from pump 24 into tray 21. A suction line 37 interconnects aspirator 36 with a drain opening 38 formed to lead into a central cavity 39 of recovery head member 28 .

Aspirator 36 includes a toner inlet flow passage 41 coupled to the discharge side of pump 24 and a toner outlet flow passage 42 leading into an enlarged continuation portion 23*a* of column 23 for supplying toner to tray 21. Outlet flow passage 42 includes smooth radially diverging side walls forming a nozzle so as to increase the speed of toner movement through a smaller constraining, low pressure passage 43 terminating at its outlet end in orifice 43*a* interconnecting flow passages 41, 42 thereby reducing the fluid pressure in passage 43.

Suction line 37 is coupled by suitable means to a suction inlet port 43*b* leading into passage 43 whereby line 37 and cavity 39 of recovery head 28 are directly subjected to a degree of suction in proportion to the rate of pumping of the toner by pump 24. Thus, as greater volumes of toner are supplied to tray 21 (and web 12) as required at high speed web movement, greater vacuum forces will be applied to recover the attendant increased amounts of excess toner.

From the foregoing, it will be readily evident that the foregoing embodiment provides a web-developing and toner-recovery system wherein a single pump supplies liquid to an aspirator which, in turn, pumps either liquid or gas while requiring no priming. In view of the lack of any moving parts within the aspirator, reliability becomes inherent.

Another embodiment, as shown in FIG. 7, also features a single pump common to both the toner supply column and the toner recovery head 28, wherein a flow-operated vacuum means applies a suction to head 28, but is arranged whereby air will not be introduced into the path of the toner leading to tray 21. The embodiment shown in FIG. 7 also has the advantage that the flow rate of its liquid pump to tray 21 cannot be limited by the presence of the aspirator on its discharge side. Other advantages will be evident from the following description thereof.

It is to be understood that the construction shown in FIG. 7 is to be used in conjunction with a web-feeding apparatus of the kind described in FIG. 1 and with a toner tray assembly as shown in FIG. 2 or the like.

The liquid flow of toner into tray 21 is accomplished by operation of a pump 44 connected to a toner supply column 46 disposed at one end in a body of toner 47 within reservoir 25. Toner is thereby pumped upwardly along column 46 via a valve 48 discharging into tray 21 whereby tray 21 can be filled to overflowing as above described. A return line 49, comparable to return lines 26, 27 above described, serves to return the overflowing toner into reservoir 25.

Means for drawing a suction on toner recovery head member 28 includes a flow-operated suction means such as an aspirator 51, comparable to aspirator 36 shown in FIG. 3. Accordingly, the same numbering of portions of aspirator 36 will be employed for aspirator 51 shown in FIG. 7.

Means forming fluid connections whereby pump 44 discharges toner in parallel to both tray 21 and to the inlet toner flow passage 41 of aspirator 51 so as to generate suction in head 28 includes a branch connection 52 coupling a portion of the stream of toner from the discharge side of pump 44 to the inlet flow passage 41 of aspirator 51 whereby a stream of toner is passed through aspirator 51 and discharged back to reservoir 25 via a drain line 53. As the stream of toner passes through aspirator 51, a suction is caused to be drawn via suction line 54 whereby vacuum is applied to toner recovery head 28.

In operation, it will be readily evident that the toner which is pumped into tray 21 will be substantially entirely free of any bubbles drawn into the stream from such sources as the vacuum recovery head 28.

It has been observed to be desirable to be able to continue to "dry" the web by continued application of the vacuum applied to head 28 after terminating toner flow to the web via tray 21. Thus, as arranged in the embodiment of FIG. 7, closing valve 48 directs the full stream of toner through aspirator 51 so as to draw a suction on vacuum recovery head 28 by circulating all the output of pump 44 via aspirator 51.

Valve 48 also serves to retain the toner in fountain tray 21 when pump 44 is deactuated. If desired, this same function can be served by eliminating valve 48 and utilizing a positive displacement pump. However, the valve permits the use of a centrifugal pump which is generally more efficient than a positive displacement pump.

In the embodiment of FIG. 8, a toner fountain tray 61 and a toner recovery head 62, generally similar to tray 21 and recovery head 28, are mounted in the upper portion of a toner reservoir 63. A pump 66, such as a centrifugal pump, having an inlet 66*a* is submerged in a body of toner 67 in the lower portion of the reservoir. The discharge of pump 66 is connected to fountain trough 61 and recovery head 62 by a manifold 68.

An aspirator 69, generally similar to aspirator 36, is mounted in recovery head 62 below a vacuum channel 71. As illustrated, the inlet of aspirator 69 is connected to manifold 68, the suction inlet communicates directly with vacuum chamber 71, and the outlet communicates with reservoir 63 through an opening 72 in the side wall of the recovery head.

Means is provided for maintaining the toner in reservoir 63 at a predetermined level notwithstanding the use of toner from the reservoir. This means includes an external reservoir 76 from which additional toner is delivered to reservoir 63 by a transfer pump 77 and a supply line 78. An overflow return line 79 returns toner above the predetermined level to the external reservoir. If desired, the external reservoir and pump can be omitted and the toner in reservoir 63 can be replenished manually. Likewise, an external reservoir and pump can be utilized with the embodiments of FIGS. 1–7, if desired.

Operation and use of the embodiment of FIG. 8 can be described briefly. Pump 66 delivers toner to tray 61 where it is applied to web 12, with excess toner overflowing directly back into reservoir 63. Unadhered toner is removed from the web at recovery head 62 and returned to the reservoir through opening 72 by aspirator 69. Pump 77 replenishes the toner in reservoir 63 from external reservoir 76, and excess toner returns to the external reservoir through overflow line 79, The embodiment of FIG. 8 has a number of important features and advantages. The fountain tray, recovery head, toner reservoir, pump and aspirator are formed as an integral unit which requires no external plumbing. The fountain and aspirator are fed by a common manifold, and an efficient centrifugal pump can be utilized. The relationship between the aspirator vacuum and the fountain flow rate can be adjusted by means of a single restrictive orifice.

From the foregoing, it will be readily evident that the system performs the method of developing latent electrostatic images carried on a web of material pursuant to the steps of moving a web of record material bearing pre-recorded latent electrostatic images thereon across an opening in a toner fountain disposed transversely of the direction of movement of the web. The next steps are to pump a stream of toner into the fountain to overflow from the top thereof to develop the images, directing the developed web across an opening to an elongate toner collection cavity, then passing at least a portion of the stream of toner via an aspirator while coupling the suction inlet port of the aspirator to the collection cavity to apply a suction to the cavity while supplying toner to the toner fountain.

What is claimed is:

1. In an electrostatic printing machine having development apparatus of the type in which fluid toner material is applied to the surface of a web to develop latent electrostatic images thereon, said development apparatus including a toner fountain and a pump for pumping toner into the fountain from a body of toner, and a vacuum channel member for removing excess toner from the surface of said web, said channel member extending transversely of the path of movement of said web and being formed with a cavity open at one side and surrounded by walls which terminate in substantially a common plane for engaging said web passing thereacross to substantially seal the open side of the cavity and having a flow passage formed to conduct fluid toner out of said cavity, the improvement comprising, aspirator means to provide a degree of suction in proportion to the discharge pumping rate of said pump, means operatively coupling said aspirator means in fluid communicaton with the discharge side of said pump for generating said degree of suction, and means operatively coupling said degree of suction in fluid communication with said vacuum channel flow passage for withdrawing toner from within said cavity.

2. In an electrostatic printing machine according to claim 1 in which said aspirator means is coupled to receive the fluid discharge of said pump and to pass same therethrough, said aspirator means including a constraining passage and orifice, and a suction line coupled between said flow passage and said constraining passage and orifice for applying suction to said cavity in a degree responsive to the rate of flow of fluid through said aspirator means.

3. In an electrostatic printing machine according to claim 1 in which said aspirator means is coupled to receive the fluid discharge of said pump and to pass same therethrough to said toner fountain, said aspirator means including a constraining passage and orifice and a suction line coupled between said flow passage and said constraining passage and orifice for withdrawing toner from said cavity via said aspirator means.

4. In an electrostatic printing machine according to claim 1 in which said aspirator means has inlet and outlet toner flow passages therethrough and a constraining passage therebetween, said inlet flow passage being disposed to receive the fluid discharge of said pump and to pass same therethrough, a suction line coupled to extend between said flow passage and said constraining passage whereby the rate of flow of toner through the aspirator means establishes the degree of suction applied to said vacuum channel member.

5. In an electrostatic printing machine according to claim 4 wherein said outlet toner flow passage discharges toner directly to said toner fountain via said aspirator means.

6. In an electrostatic printing machine according to claim 4 further comprising fluid connections wherein said pump discharges toner in parallel to both said toner fountain and to said inlet toner flow passage of said aspirator means.

7. In an electrostatic printing machine of a type having means for applying fluid toner material to a surface of a web of print material including a toner fountain and a pump for pumping toner into the fountain from a body of toner, a vacuum channel member extending transversely of the path of movement of the web for removing toner from the web surface, the channel member being formed with a cavity open at one side and surrounded by walls which terminate in substantially a common plane for engaging the web passing thereacross to substantially seal the open side of the cavity, a flow passage formed to lead fluid toner out of the cavity, flow-operated vacuum means disposed on the discharge side of the pump and coupled in fluid suction communication to the flow passage, said vacuum means serving to pass a flow of toner therethrough in a manner serving to withdraw toner material from said cavity via said flow passage under a degree of suction responsive to the rate of passing toner therethrough, fluid connections serving to cause said pump to discharge toner in parallel to both said toner fountain and said vacuum means, and valve means interposed between said toner fountain and said pump for selectively discontinuing the flow of toner to said fountain while continuing to supply a stream of toner to said vacuum means so as to continue to draw a vacuum on said cavity after discontinuing the flow of toner to the toner fountain.

8. In an electrostatic printing machine of a type having means for applying fluid toner material to a surface of a web of print material, the improvement comprising a reservoir for holding a body of toner material, a toner fountain mounted in the upper portion of the reservoir and positioned for applying toner material to the surface of the web of print material, means including a pump mounted in the reservoir for delivering toner material to the fountain, a toner recovery head including a vacuum chamber mounted in the upper portion of the reservoir for engaging the surface of the web of print material to remove unadhered toner material therefrom, and flow operated vacuum means carried by the recovery head and having a suction inlet communicating with the vacuum chamber, a flow inlet communicating with the discharge side of the pump, and an outlet communicating with the reservoir, the discharge side of the pump being also connected to the toner fountain and to said flow inlet by a common manifold.

9. The electrostatic printing machine of claim 8 wherein the flow operated vacuum means is an aspirator.

10. The electrostatic printing machine of claim 8 further including an additional toner reservoir mounted externally of the first named reservoir, means including an additional pump for delivering toner material from the additional reservoir to the first reservoir, and an overflow line for returning toner above a predetermined level in the first reservoir to the additional reservoir.

* * * * *